US008545127B2

(12) United States Patent
Bleile et al.

(10) Patent No.: US 8,545,127 B2
(45) Date of Patent: Oct. 1, 2013

(54) RIG MAT SYSTEM AND METHOD OF MAKING THE SAME

(75) Inventors: Leonard Bleile, Calgary (CA); Jared Michael Bathelt, Leduc (CA); Brian Matthew Stasiewich, Leduc (CA)

(73) Assignee: Strad Energy Services Ltd

( * ) Notice: Subject to any disclaimer, the term of this patent is extended or adjusted under 35 U.S.C. 154(b) by 0 days.

(21) Appl. No.: 13/155,302

(22) Filed: Jun. 7, 2011

(65) Prior Publication Data

US 2011/0299923 A1 Dec. 8, 2011

Related U.S. Application Data

(60) Provisional application No. 61/352,044, filed on Jun. 7, 2010.

(30) Foreign Application Priority Data

Jun. 7, 2011 (CA) ..... 2742200

(51) Int. Cl.
*E01C 5/00* (2006.01)

(52) U.S. Cl.
USPC ..... 404/34; 404/35; 404/36; 404/37; 404/41; 405/302.4

(58) Field of Classification Search
CPC ..... E01C 5/00
USPC ..... 404/17, 18, 34–37, 41; 405/16, 405/17, 302.4–302.7
See application file for complete search history.

(56) References Cited

U.S. PATENT DOCUMENTS

| | | | | |
|---|---|---|---|---|
| 3,859,000 | A * | 1/1975 | Webster | 404/41 |
| 4,152,875 | A * | 5/1979 | Soland | 52/223.7 |
| 4,277,201 | A * | 7/1981 | Abell | 404/35 |
| 4,804,293 | A * | 2/1989 | Varkonyi et al. | 405/15 |
| 2003/0133751 | A1 * | 7/2003 | Smith | 404/35 |
| 2008/0233825 | A1 * | 9/2008 | Gamaleldin | 442/401 |
| 2009/0130368 | A1 * | 5/2009 | Beihoffer et al. | 428/68 |
| 2009/0286043 | A1 * | 11/2009 | De Baets et al. | 428/117 |
| 2009/0297266 | A1 * | 12/2009 | Stasiewich et al. | 404/36 |
| 2010/0209187 | A1 * | 8/2010 | Relland et al. | 404/35 |
| 2011/0296862 | A1 * | 12/2011 | Wold | 62/259.1 |
| 2012/0063844 | A1 * | 3/2012 | Wold | 404/35 |
| 2012/0163910 | A1 * | 6/2012 | Dagesse | 404/41 |

* cited by examiner

*Primary Examiner* — Raymond W Addie
(74) *Attorney, Agent, or Firm* — Sean Goodwin

(57) ABSTRACT

A multi-layer rig mat system and a method for implementing the rig mat system is provided. The rig mat system has a rig mat formed by interconnecting a plurality of panels in an edge-to-edge arrangement and one or more barrier layers placed between the rig mat and the terrain. The barrier layer prevents contamination of the terrain below the rig mat by water and other undesirable fluids seeping through gaps or discontinuities in the rig mat. The barrier layer also prevents heat transmission from the rig mat to the terrain below the rig mat.

35 Claims, 16 Drawing Sheets

RIG MAT SYSTEM AND METHOD OF MAKING THE SAME

FIELD OF THE INVENTION

The invention relates to a rig mat system placed over sensitive ground or terrain and methods for making same. More particularly, the rig mat has a plurality of interconnected panels to form a rigid working layer and one or more barrier layers are placed between the rig mat and the terrain.

BACKGROUND OF THE INVENTION

Rig mats, which are also known as rig pads and road mats, have been used, for example, for construction roadways, camp mats, and drilling rig platforms on surfaces such as Arctic tundra, in order to provide a temporary rigid surface on which equipment such as motor vehicles can operate. Rig mats may assist in reducing damage to the softer surface below, and may prevent motor vehicles or other objects from becoming bogged down. They can also prevent the softer surface from thawing when the ambient air temperatures are above freezing, thereby retaining the integrity of the rigid surface for supporting loads placed thereon. The service of rig mats can be severe including the support of heavy loads including dynamic loads of wheeled and tracked vehicular traffic.

Conventional rig mats have been constructed with generally rectangular steel frame supporting wooden platforms within the frames for example. Some next generation rig mats utilize a composite material for the platform. Rig mats tend to be made of interconnectable panels, so that the panels are readily transported, and used and reused for temporary surfaces of various desired dimensions.

Generally rig mats do not provide any substantial thermal or reflective insulation value. More contemporary composite mats can have a core filled with insulating foam to provide a thermal barrier. In such a construction a top and bottom sheet of fibrous reinforcing material (FRP) is attached to an insulating material core. Insulated rig mats were introduced with the objective of keeping the ground frozen longer so as to keep the platform in place for a longer duration, thus increasing the useful life. With the high daily expense of drilling rigs, any increase in a drilling season results in significant benefits.

Arrangements which require interconnected panels, even with an insulating core, have inherent problems due to gaps, both physical gaps and increased thermal conductivity, caused by the structural interconnecting points between panels, defeating the insulation provided by the foam filled cores. There are also problems with effectively bonding foam to the skins of an insulated core which reduces the shear strength of the structure. Further, the physical gaps between panels are pathways for spills to the ground, substantially any spill being undesirable. Water and other undesirable fluids can seep through such gaps and contaminate the ground below the rig mat. When used in the Arctic the rig mats are generally placed over a bed of gravel which is typically remediated to ensure any spills, whether documented or not, are treated. The remediation itself comes with an environmental cost for equipment, consumables and fuel. One form of remediation is to steam clean the gravel after each drilling operation which involves transporting the gravel to a steam cleaning plant which is a cumbersome task in the Arctic and other remote areas typical of drilling operations.

It is known to form temporary surfaces of various desired dimensions by interconnecting rig mat panels using connectors such as complementary L-shaped appendages or connectors described in US Patent Application Publication No. 2009/0297266 to Stasiewich et al. The connectors are thermal conductors and are not leakproof.

There is a need for a rig mat which in addition to providing a rigid surface, minimizes leak and thermal issues.

SUMMARY OF THE INVENTION

Embodiments described herein are directed to a rig mat system comprising a continuous barrier layer between a working surface layer or rig mat and the terrain on which the rig mat is placed to prevent contamination of the terrain below the rig mat by water and other undesirable fluids seeping through gaps or discontinuities in the rig mat. In one embodiment, the barrier layer further forms a thermal barrier between the discontinuities in the rig mat and the terrain. In another embodiment, the rig mat system further comprises an additional barrier layer or protective layer between the first barrier layer and the terrain.

Embodiments described herein are also directed to a connection means or connectors for interconnecting panels of the rig mat so that relative movement between the panels is prevented. The connectors also restrict longitudinal movement of the panels. In another embodiment, the connectors are associated with a filler which fills an assembly gap formed between the connecting edges of two panels during interconnection thereby forming a substantially continuous surface in the rig mat between the connecting sides of the two panels. The filler also interacts with the connection means to prevent lifting of the panels with respect to each other after assembly of the rig mat. In embodiments, the connectors can be used generally for connecting rig mat panels and in other embodiments the connectors are used for connecting rig mat panels associated with at least one barrier layer.

Accordingly in one broad aspect a rig mat system for protecting a terrain from at least liquid is provided. The system comprises a plurality of panels having connecting edges and a rig mat comprising the plurality of panels interconnected by their connecting edges in an edge-to-edge arrangement. Discontinuities are formed along the connecting edges and form a leak path to the terrain below. The system further comprises a barrier layer between the rig mat and the terrain. A surface area of the barrier layer is at least equal to a surface area of the rig mat so as to form a substantially continuous liquid barrier between the discontinuities and the terrain.

Accordingly in another broad aspect a method for implementing a multi-layer rig mat system on a terrain for protecting the terrain from at least liquid is provided. The method comprises forming a barrier layer of a desired dimension; placing the barrier layer over the terrain; and forming a rig mat of a desired dimension by arranging a plurality of panels in an edge-to-edge relationship and interconnecting the panels at connecting edges of the panels. Discontinuities are formed along the connecting edges and form a leak path to the terrain below. The method further comprises placing the rig mat on the barrier layer such that the barrier layer is below the discontinuities in the rig mat and the barrier layer forms a substantially continuous liquid barrier between the discontinuities and the terrain.

Accordingly in another broad aspect connectors for interconnecting the panels of the rig mat are provided. The connectors are located at the connecting edge of each panel. The connectors comprise a first U-shaped channel along the connecting edge of a first panel of the plurality of panels. The first channel defines a recess and has a first stop located along an upstanding member of the first channel spaced from the connecting edge of the first panel. The connectors further comprise a second inverse U-shaped channel along the connecting edge of a second panel of the plurality of panels. The second channel has a second stop located along a depending member of the second channel spaced from the connecting edge of the second panel. Insertion of the depending member of the second channel in the recess of the first channel, so that the depending member of the second channel is parallel and spaced from the upstanding member of the first channel, interconnects the first panel to the second panel. The insertion results in an assembly gap between the connecting edge of the first panel and the depending member of the second panel.

In another aspect of the connectors, the connectors are associated with a filler for fitment into the assembly gap. The filler extends from the depending member towards the connecting edge of the first panel. Fitment of the filler in the assembly gap forms a substantially continuous surface in the rig mat between the connecting edges of the first panel and second panel and prevents relative movement of the second panel towards the first panel.

DETAILED DESCRIPTION OF THE PREFERRED EMBODIMENTS

Herein, embodiments are directed to a rig mat system comprising a barrier layer between a plurality of interconnected rig mat panels and a terrain on which the assembled rig mat is located. Accordingly, regardless of any liquid or heat seeping through the rig mat such liquid or heat is prevented from reaching the terrain.

Figure 1:
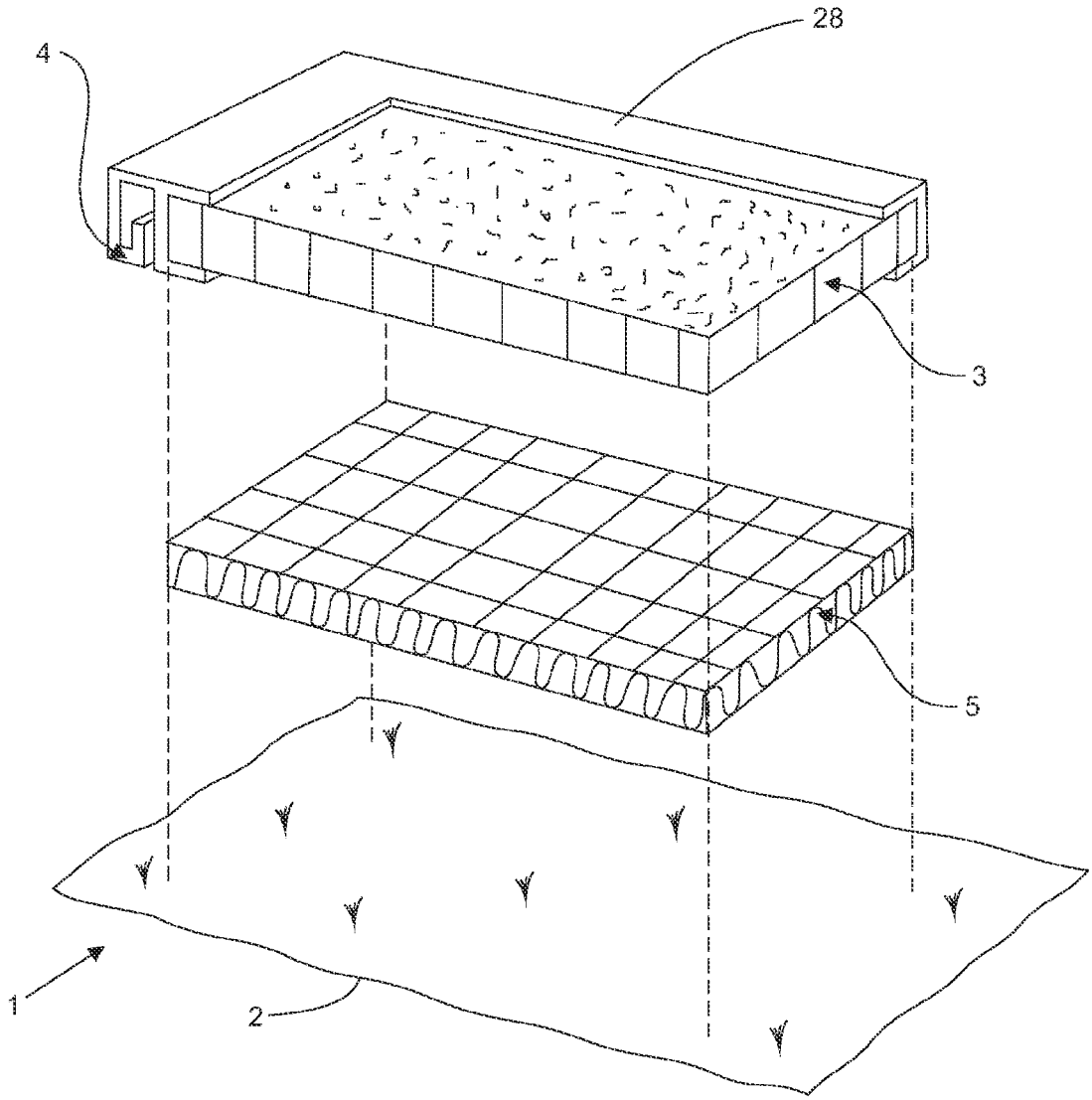
FIG. 1 is an exploded perspective view of a rig mat system comprising a rig mat and a barrier layer for placement over a terrain according to one embodiment.
Figure 2:
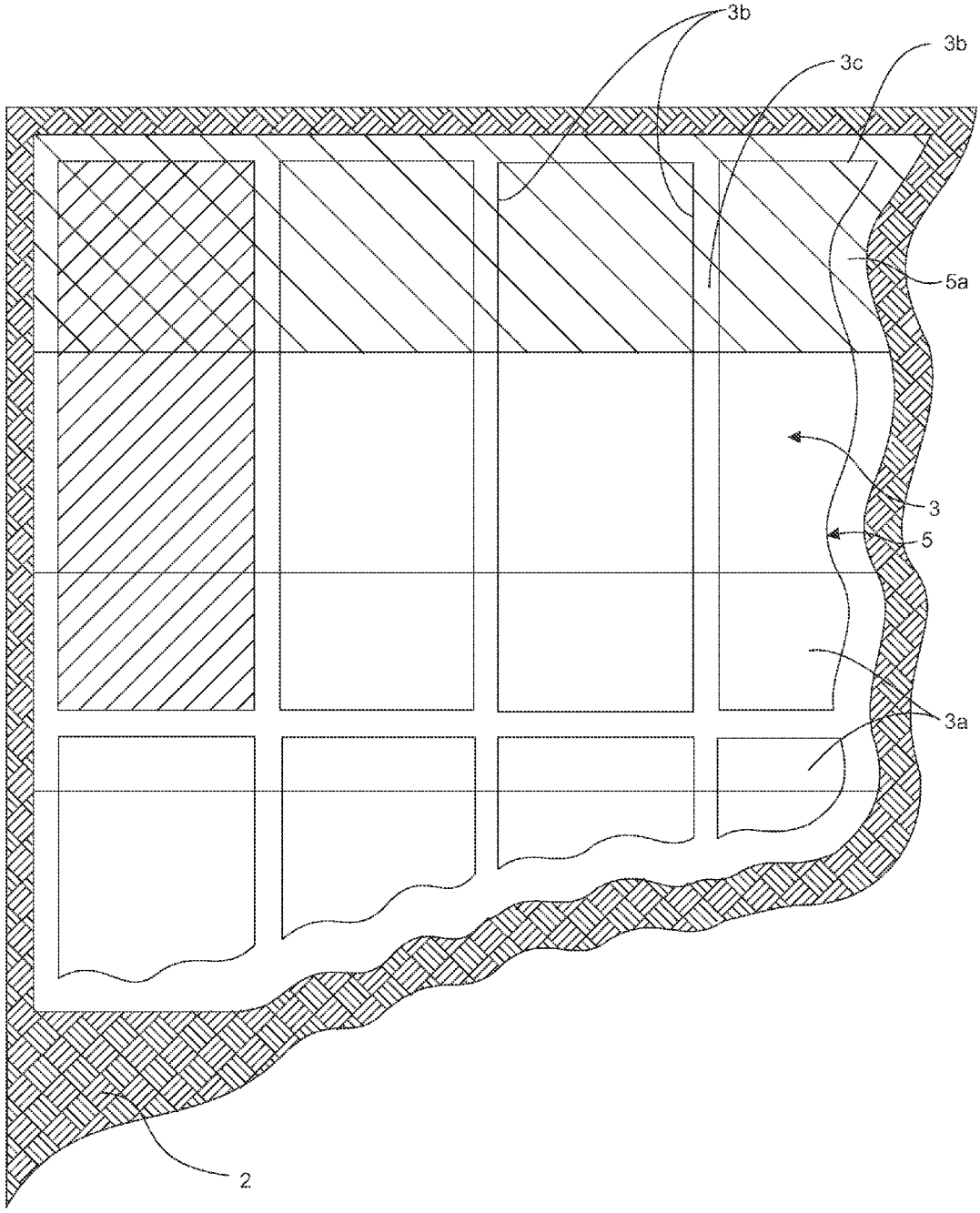
FIG. 2 is a partial plan view of the rig mat system of FIG. 1.

FIGS. 1 and 2 illustrate one embodiment of a rig mat system 1 for use over a terrain 2. Typical terrain sensitive to seepage include a frozen terrain or a swampy terrain. The assembled rig mat system 1 comprises a rig mat 3 formed by interconnecting a plurality of panels 3*a*. Each panel 3*a* comprises connecting edges 3*b*. The rig mat 3 is formed by interconnecting the plurality of panels 3*a* by their connecting edges 3*b* in an edge-to-edge arrangement by connection means 4. Interconnection of the panels 3*a* results in discontinuities 3*c* at the connecting edges 3*b* (best seen in FIG. 2). The discontinuities 3*c* in the rig mat 3 form a leak path from the rig mat 3 to the terrain 2 through which thermal energy or liquid can pass. Accordingly, the rig mat system 1 further comprises at least one barrier layer 5 between the rig mat 3 and the terrain 2. A surface area of the barrier layer 5 is at least equal to a surface area of the assembled rig mat 3 so as to form a substantially continuous liquid barrier between the discontinuities 3*c* and the terrain 2.

In one embodiment, each rig mat panel includes a frame 28 (best seen in FIG. 1) preferably made of metal such as steel and includes the connecting edges 3*b*. The connection means 4 is secured, such as by welding, to the connecting edges 3*b*.

The rig mat 3 forms a rigid working layer upon which work is performed. It is known to operate equipment on rig mats, such equipment being otherwise very harsh on terrains. Equipment includes tracked, skid steer bulldozers and excavators. It is also known to place large storage vessels on rig mats, the mode of positioning the storage vessel including dragging the vessel on skids. The rig mat 3 may be formed of interconnected composite or wooden panels 3*a*. Panels 3*a* are amenable to shipping to a site in conventional sized loads, such as upon trailers, yet permit assembly into large surfaces. Rig mats of 60 feet×60 feet are typical, made up of 14 panels 3*a*, each panel 3*a* being about 8.5 feet wide and about 30 feet long. Composite panels 3*a* might be in the order of about 1 inch thick. The rig mat 3 is structured to support equipment and activities thereon. The rig mat 3 may have a surface layer forming a top traction layer (not detailed). The traction layer can improve traction for static and dynamic activity thereon, and protect the underlying structure of the rig mat itself. In one embodiment, the traction layer is a formulation comprising rubber granules.

The traction layer would typically have the properties of good bonding, good abrasion resistance and good anti-slip.

Composite material panels 3*a* have an insulation value greater than that of conventional wood panels. Use of composite material panels 3*a* also provides a light weight and low profile rig mat system which reduces trucking and storage costs. One form of composite material panel is formed as described in US Patent Application Publication No. 2009/0286043 to De Baets et al. Such a composite material panel comprises a honeycomb core panel having a first face and a second opposite face with an array of generally hexagonal tubular cells defined by walls of the core panel extending between the first and second faces. The cells are formed from strips arranged side by side of a porous fibrous material which is heat sealed at a sealing line to define the generally hexagonal cells. An insulating foam material such as polyurethane foam fills the tubular cells. A first fibrous reinforcing cover sheet such as a fiberglass mat (or carbon fiber, aramid fiber, Kevlar fiber, polyester fiber, natural fiber—e.g. hemp, flax, straw) extends over the first face of the core panel and a second fibrous reinforcing cover sheet extends over the second face of the core panel. The first and second cover sheets are joined or connected with a set resin material which extends in strings from the cover sheets in and through the foam so as to form an integral structure of the resin extending between the walls and the sheets.

Figure 3:
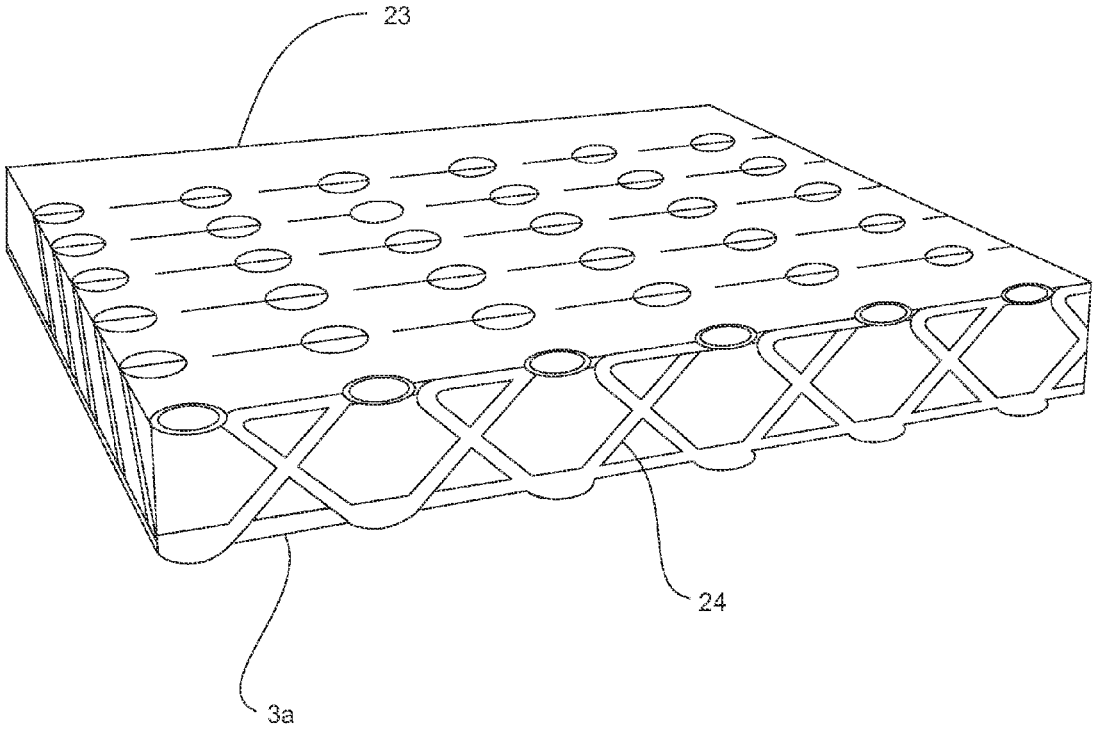
FIG. 3 is a perspective view of an embodiment of a panel of the rig mat of FIG. 1 showing Z-axis weaving in the panel.

As shown in FIG. 3, and in one embodiment, the rig mat panels 3*a* are made of a blend of polyester which has good flame retardant capabilities and low smoke spread. The panel 3*a* incorporates a Polyisocyanurate foam 23 and Z-axis weaving 24 to greatly increase the shear modulus when compared to the conventional composite designs. An article currently available on the World Wide Web at http://www.composites-world.com/articles/structural-polyurethanes-bearing-bigger-loads provides a description of inserting, or "tufting," glass fiber into polyurethane foam sheets, using fiber-insertion equipment patented by Nida-Core having offices at St. Lucie, Fla., USA. The conventional composite designs can suffer from delamination due to poor bonding between the skin (cover sheet) and core. The conventional honeycomb inserts do not allow a good bonding process as well as the contact surface area is typically less than 5% of the mat area. Wetted fiber insertions and an internal baffle are typically utilized to overcome these difficulties. U.S. Pat. No. 5,061,418 to Ware discloses a method of forming a composite sandwich core molded article wherein baffles are placed in the mold to control the flow path of a heating fluid.

Below the interconnected panels 3*a* is at least one barrier layer 5. The barrier layer 5 can be a unitary construction or it can be formed by interconnecting or overlapping panels. In one embodiment and as shown in FIG. 2, the barrier layer 5 comprises a plurality of sections 5*a*. Section edges 5*b* of the barrier layer 5 are offset from the discontinuities 3*c* in the rig mat 3. Thus, all discontinuities 3*c* in the rig mat 3 have an uninterrupted barrier layer therebelow. Therefore, liquid traveling through or along the discontinuities 3*c* in the rig mat 3, is stopped or blocked by the is barrier layer and is not permitted to reach the terrain 2.

Figure 5A:
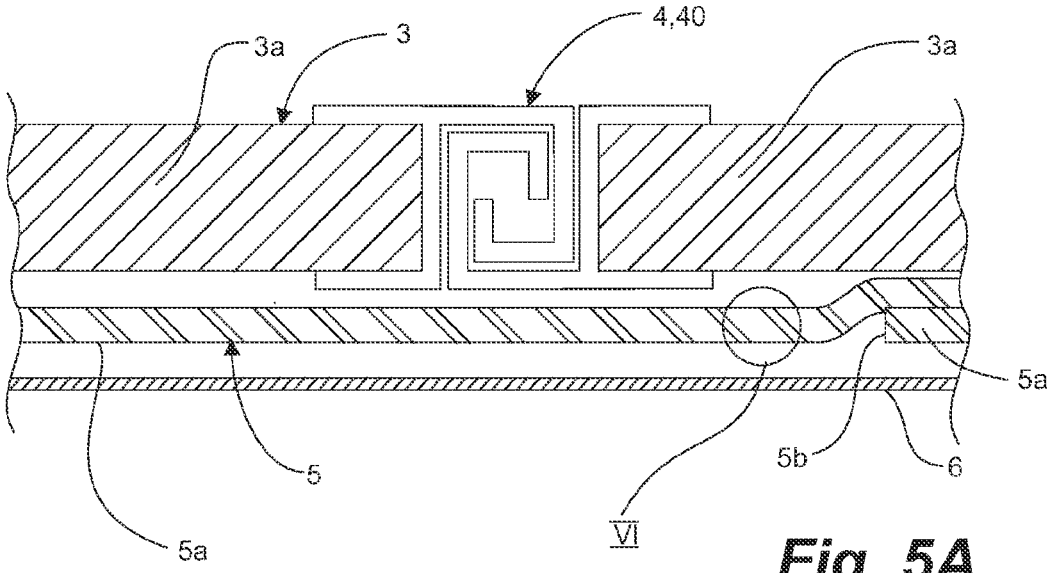
FIGS. 5A and 5B illustrate various ways of forming the barrier layer of the rig mat system of FIG. 1.

In one embodiment and as shown in FIG. 5A, the barrier layer 5 is formed by interconnecting the sections 5*a* along the section edges 5*b*.

Figure 5B:
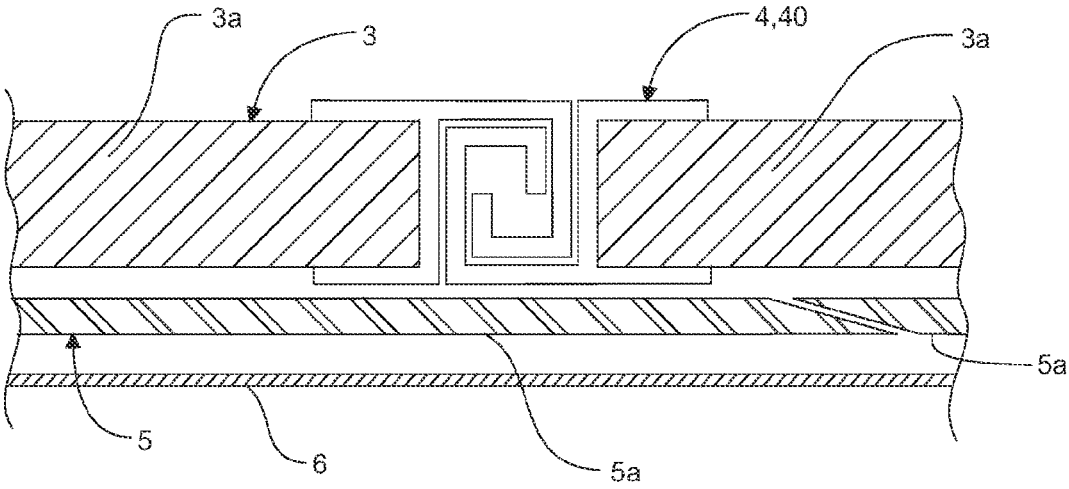

In another embodiment and as shown in FIG. 5B, the barrier layer 5 is formed by arranging the sections 5*a* along the section edges 5*b*.

In another embodiment, the section edges 5*b* of the barrier layer 5 are plastic and the sections 5*a* are interconnected by heat sealing or wedge welding.

In another embodiment, the section edges 5*b* are interconnected by interconnecting means such as a hook-and-loop fastener, double-sided tape or zipper.

Figure 4:
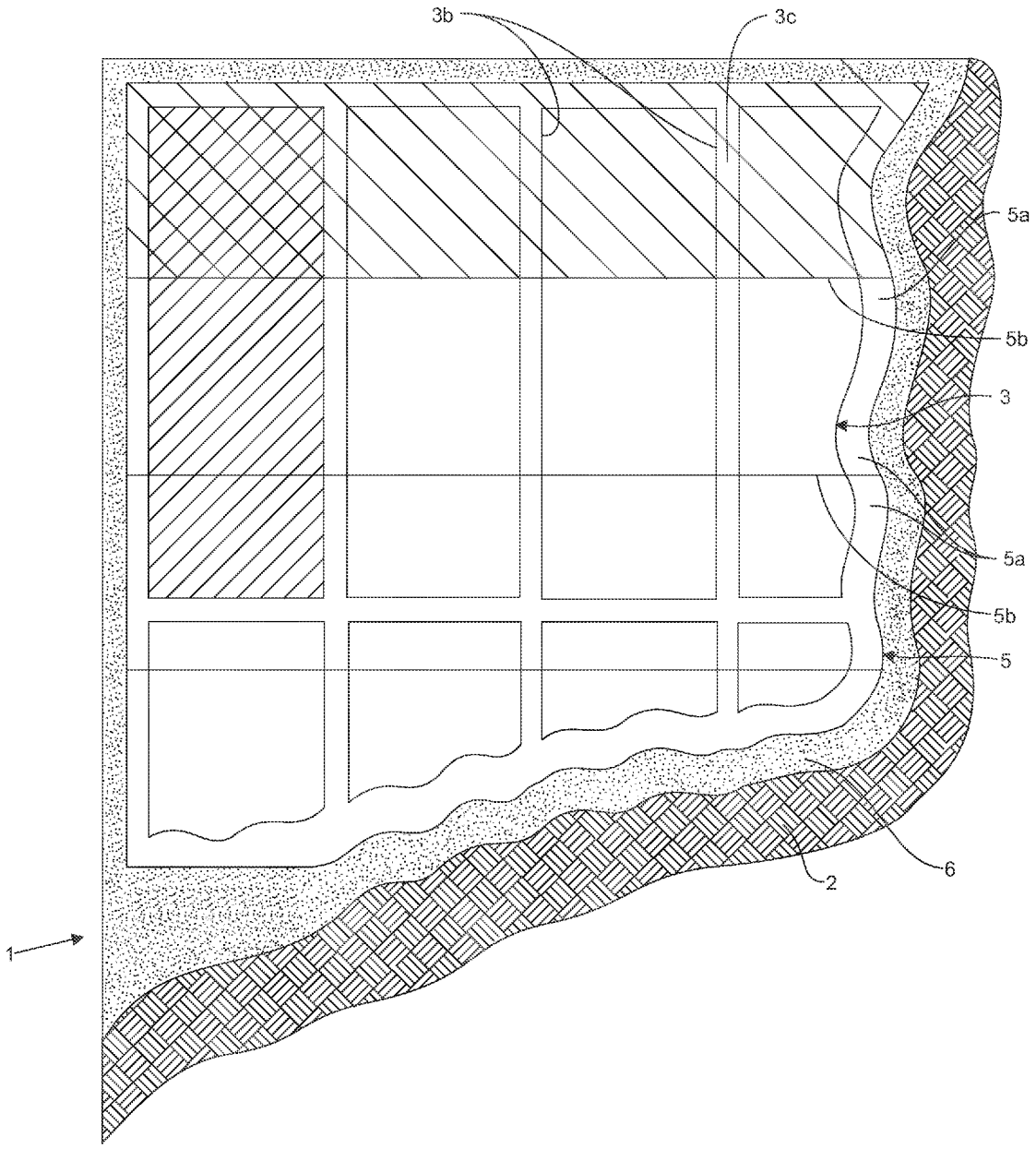
FIG. 4 is a partial plan view of the rig mat system of FIG. 1 showing the barrier layer of the rig mat system being placed on a protective layer.

A barrier layer 5 which is formed by interconnecting sections 5*a*, may be susceptible to leakage at the section edges. In order to overcome this problem and as shown in FIG. 4, the rig mat system 1 may further comprise a protective layer 6 contacting the terrain 2 (not shown in FIG. 4) and underlying the entirety of the rig mat 3 and the barrier layer 5 to prevent any liquids seeping through the plurality of sections 5*a* of the barrier layer 5 from reaching the terrain 2. Typically the protective layer 6 is a unitary, contiguous material which extends entirely across the entirety of the footprint of the rig mat 3 and the barrier layer 5 in a single contiguous sheet. A suitable material of the protective layer is a reinforced polyethylene, such a protective layer typically having little insulation value.

Figure 6:
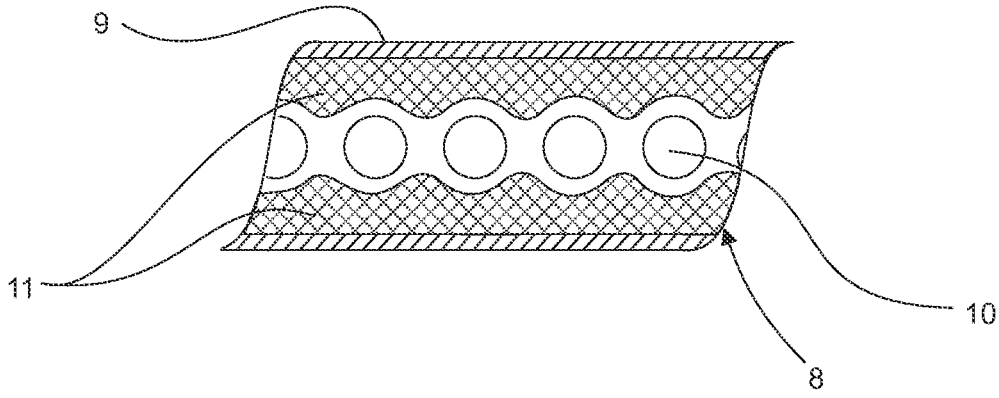
FIG. 6 is an enlarged view of the circled portion VI of FIG. 5A showing the various elements of the barrier layer.

In one embodiment, the barrier layer 5 further forms a thermal barrier below the discontinuities 3*c* and below the rig mat 3 generally. As shown in FIG. 6, the barrier layer 5 comprises a geo-membrane 8 associated with a liquid impermeable sheet 9 to form both the liquid barrier and the thermal barrier. The barrier layer 5 forms a thermal barrier and a labyrinth seal to interfere with heat transmission and liquid seepage or wicking of liquids from the rig mat 3. The geo-membrane 8 can be rolled or folded for transport. In one embodiment and as shown in FIG. 6, the geo-membrane 8, typically a strong loosely-woven geo-textile fabric, includes a core comprising a rigid plastic reinforcement mesh 10 encapsulated in layers of woven strong fabric 11. The mesh 10 adds to in-plane strength and the combination of the mesh 10 and the fabric 11 provide a stagnant air, thermal resistance barrier. In one embodiment, the geo-membrane 8, being porous, is encased in the liquid impermeable sheet 9 such as reinforced polyethylene (RPE) (sourced from Layfield www.layfield-qroup.com) to form a liquid barrier. The encased geo-membrane is both thermal and liquid barrier. Such a impervious geo-membrane barrier layer can be in the order of ⅜" to ½" inches thick and formed in sections of about 10" wide by about 60 feet long.

In one embodiment, core of the geo-membrane 8 can be a high stranded high density polyethylene matrix, configured to create interstitial space. The geo-membrane 8 can have energy storing materials such as air, water, insulating foam or glycol injected into the interstitial space formed by the polyethylene matrix.

In one embodiment, the barrier layer 5 has a thermal resistance value (R-value) in the range of about R10.

If the barrier layer 5 comprises a plurality of panels 5*a*, one can rely on the labyrinth effect of spacing the discontinuities 3*c* in the rig mat 3 from section edges 5*b*. A labyrinth form of seal retards or prevents heat or liquid loss therethrough. The section edges 5*b* can be overlapped, adding yet another level of a restrictive labyrinth path, yet retaining the capability for ready disassembly upon project termination. The section edges 5*b* can be sealed to ensure a contiguous impervious layer. The seal can be reversible, such as using heat-sealing which can be heat-released for disassembly.

Figure 7C:
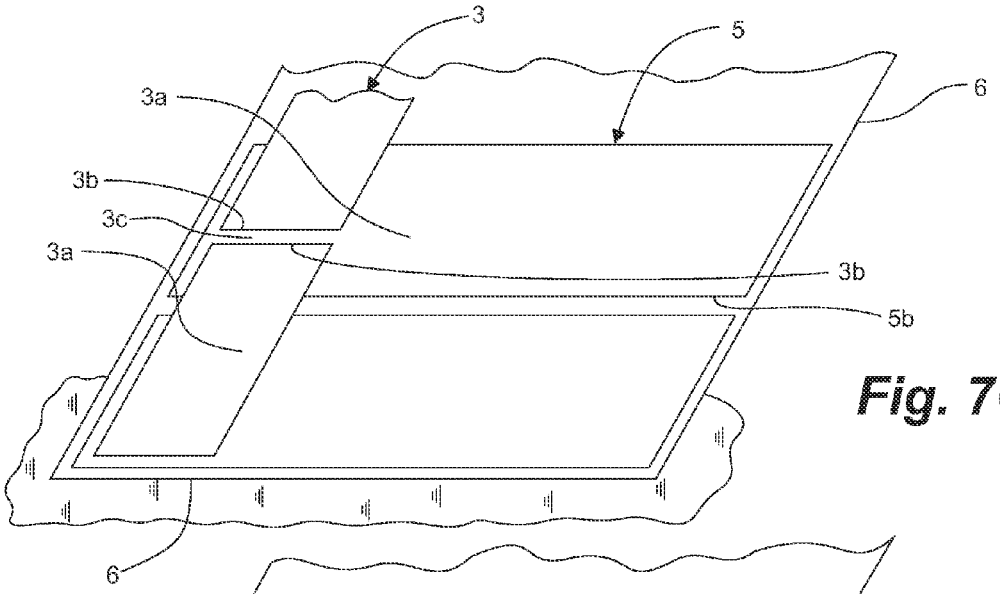
FIGS. 7A, 7B and 7C illustrate an embodiment of the steps for assembling the rig mat system of FIG. 4.
Figure 7B:
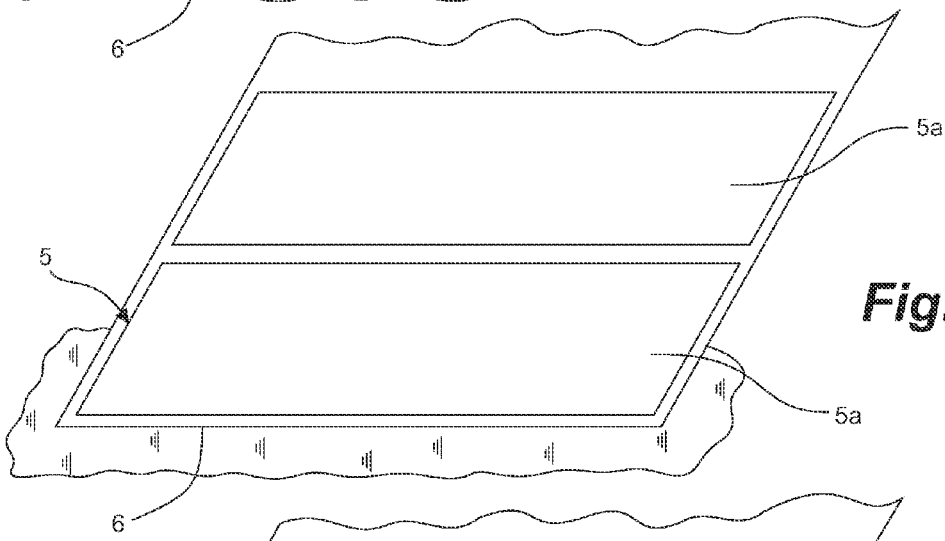
Figure 7A:
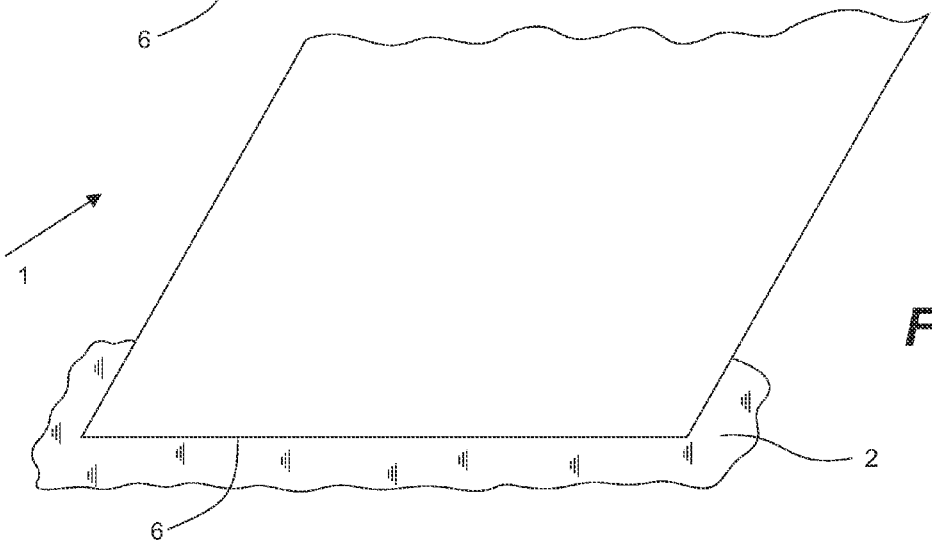
Figure 7D:
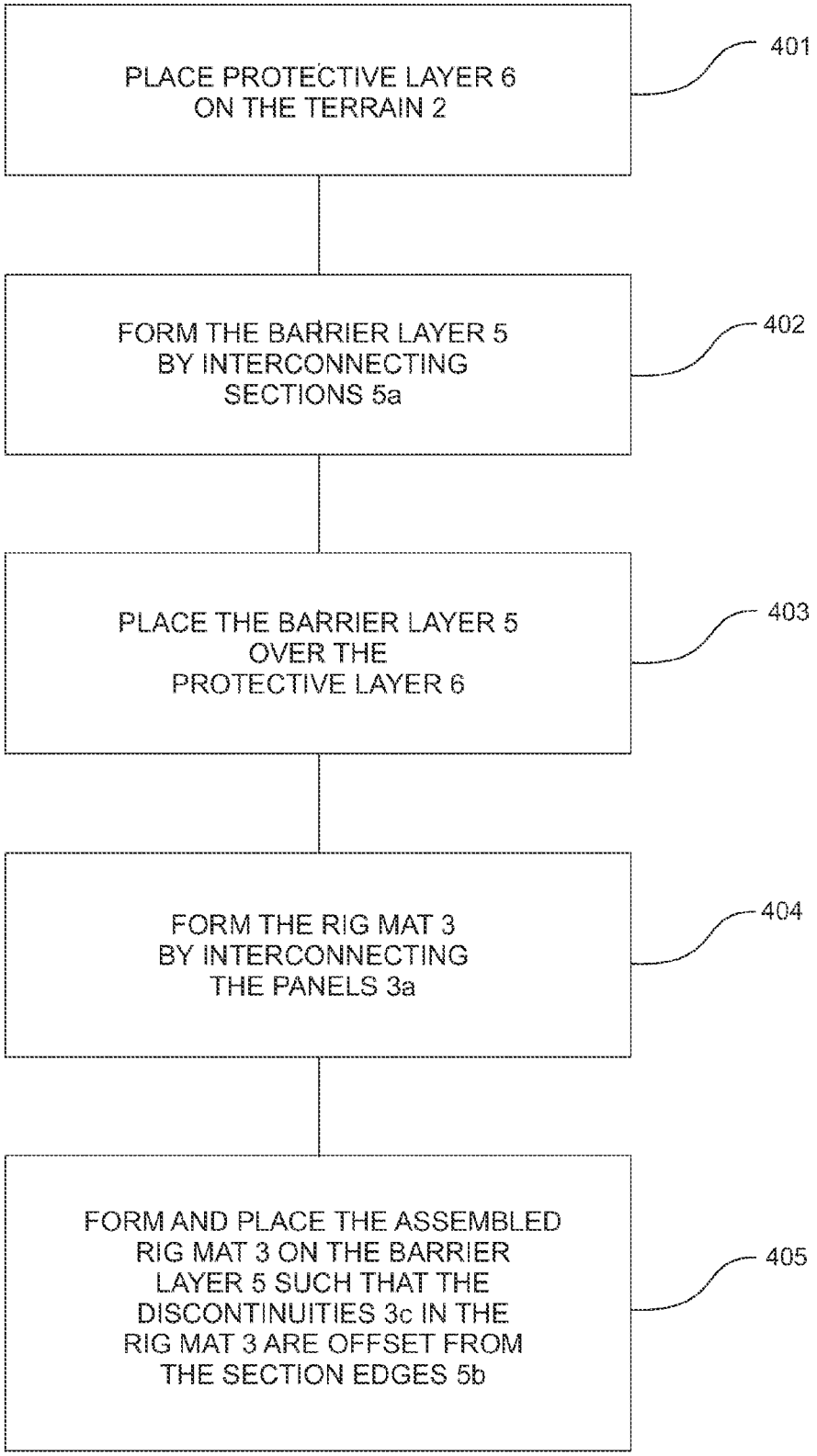
FIG. 7D is a flow chart illustrating the steps of FIGS. 7A, 7B and 7C.

FIGS. 7A, 7B, 7C and 7D illustrate one embodiment of a step-wise assembly of one embodiment of a multi-layer rig mat system comprising the rig mat 3, the barrier layer 5 and the protective layer 6. The rig mat 3 is formed by interconnecting a first matrix or array or plurality of panels 2*a* and the barrier layer 5 is formed by interconnecting a plurality or array of sections 5*a*. The protective layer 6 is a unitary, contiguous material. Surface area of the protective layer 6 is at least equal to the aggregate surface area of the plurality of sections 5*a* of the barrier layer 5. In one embodiment, surface area of each panel 3*a* of the rig mat 3 is different from a surface area of each section 5*a* of the barrier layer 5. In one embodiment, the rig mat system is implemented as follows: the protective layer 6 is placed over the terrain 2 (FIG. 7A and block 401 of FIG. 7D); the barrier layer 5 of a desired dimension is formed by interconnecting the sections 5*a* (block 402); the barrier layer 5 is placed over the protective layer 6 (FIG. 7B and block 403); the rig mat 3 of a desired dimension is formed by arranging the plurality of panels 3*a* in an edge-to-edge relationship and interconnecting the panels 3*a* at the connecting edges 3*b* of the panels by connectors 4 (not shown in this series of figures) (block 404); and the rig mat 3 is placed on the barrier layer 5 such that the discontinuities 3*c* in the rig mat 3 are offset from the section edges 5*b* so that barrier layer 5 is below the discontinuities 4*c* in the rig mat 3 and the barrier layer 5 forms a substantially continuous liquid barrier between the discontinuities 4*c* and the terrain 2 (FIG. 7C and block 405).

Herein, the steps of "interconnecting" and "placing" may be carried out in a serial or contemporaneous manner.

In one embodiment and as shown in FIG. 2, the panels 3*a* of the rig mat 3 are rectangular and the sections 5*a* of the barrier layer 5 are rectangular and the panels 3*a* of the rig mat 3 are arranged perpendicular to the sections 5*a* of the barrier layer 5. This minimizes coincidence of the section edges 5*b* and the discontinuities 3*c*.

In one embodiment, a heavy lifting equipment (not shown) is typically used to assemble the rig mat 3 and place the assembled rig mat 3 on the barrier layer 5 already assembled.

In another embodiment, the rig mat 2 is assembled and placed on the barrier layer 5 as follows: a first set of one or more rig mat panels 3*a* are interconnected, the first set of interconnected rig mat panels 3*a* is placed on the barrier layer 5 using heavy lifting equipment located on terrain 2 outside the boundary of the barrier layer 5. The heavy lifting equipment accesses regions of the barrier layer for placement of further sets of interconnected rig mat panels 3*a* by driving over the first set of interconnected rig mat panels 3*a*.

In one embodiment, the panels 3*a* are interconnected by connection means 4 described in US Patent Application Publication Nos. US 2009/0301004 to Dagesse and US 2009/0297266.

In one embodiment, the panels 3*a* of the rig mat 3 are interconnected by connection means 40 as shown in FIGS. 8 to 12. The connection means 40 secures the panels 3*a* together regardless of equipments placed and moving thereon. Particularly during movement of heavy equipment, the panels 3*a* may be urged to move apart from each other and to move longitudinally. One embodiment of the connection means 40 resists both these movements of the panels 3*a*. Further, uneven terrain 2 or partial loading on a panel 3*a* can result in a lifting of one panel relative to an adjacent panel 3*a* and can act as a form of hinge to permit connection despite uneven terrain. Another embodiment of the connection means 40 resists lifting movement of the panels 3*a*. The working of the connection means 40 is described in relation to connection of two panels 3*a* of the rig mat 3.

Figure 8:
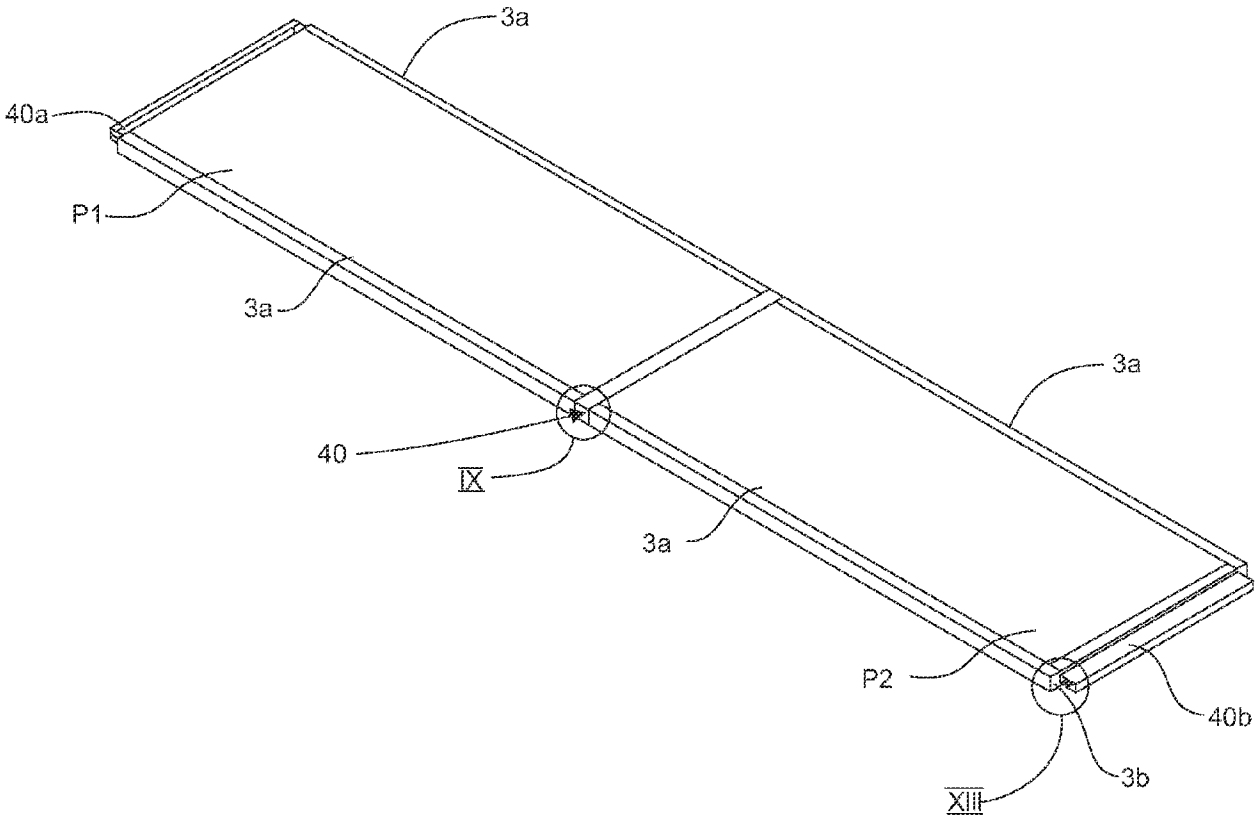
FIG. 8 is a perspective view of two panels of the rig mat of FIG. 1 interconnected by connectors according to another embodiment.
Figure 11:
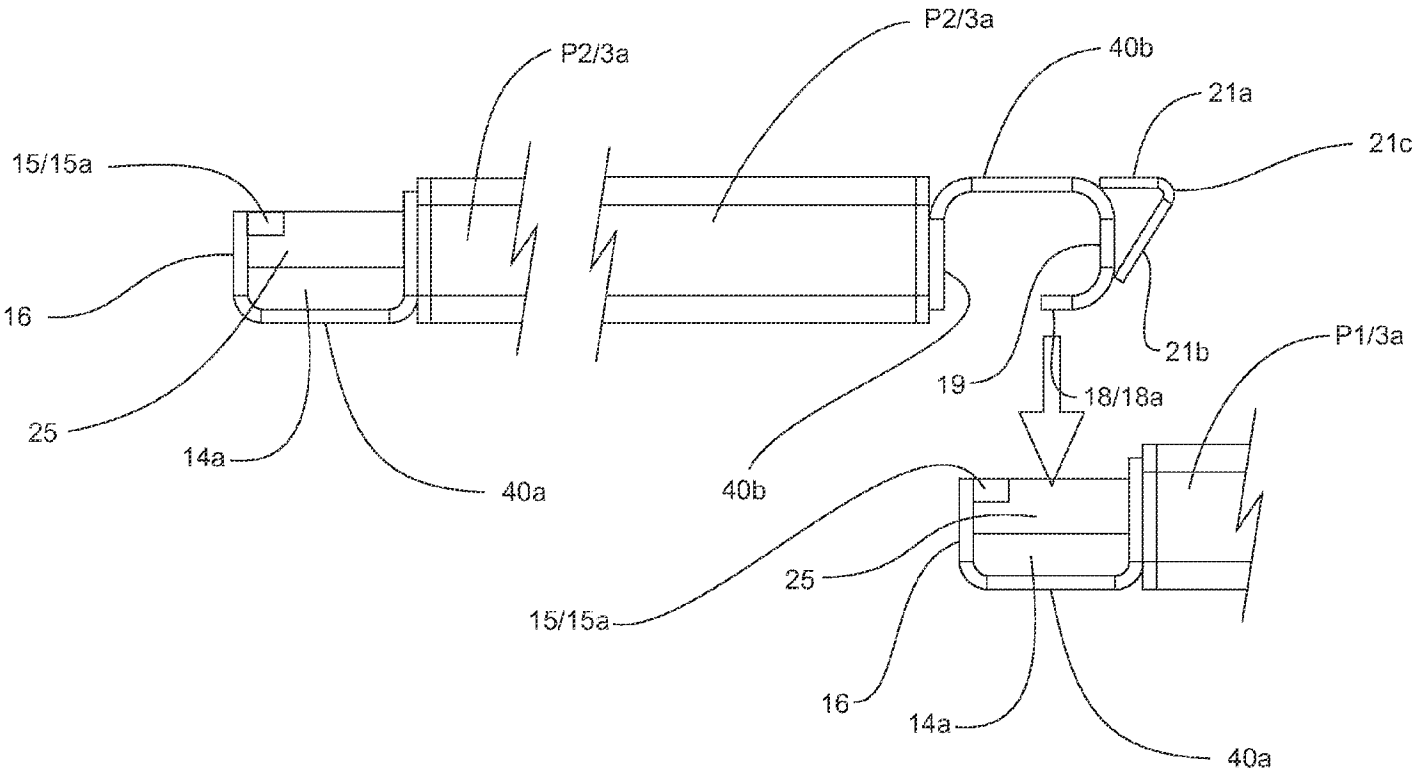
FIG. 11 is a detailed view of the connectors located at connecting edges of the two panels of FIG. 8.

As shown in FIG. 8, two panels P1 and P2 of the rig mat 3 are placed adjacent to each other such that a connection part 40*a* of the connection mean 40 located at the connecting edge 3*b* of panel P1 faces complementary connection part 40*b* of the connection means located at the connecting edge 3*b* of the second panel P2. Details of connection part 40*a* and connection part 40*b* are best seen in FIG. 11. The connection part 40*a* comprises a first U-shaped channel 14 along the connecting edge 3*b* of panel P1. The first channel 14 defines a recess 14*a* and has a first stop 15 located along an upstanding member 16 of the first channel spaced from the connecting edge 3*b* of the first panel P1. The connection part 40*b* comprises a second inverse U-shaped channel 17 along the connecting edge 3*b* of rig mat panel P2. The second channel 17 has a second stop 18 located along a depending member 19 of the second channel spaced from the connecting edge of the second panel P2.

Figure 9:
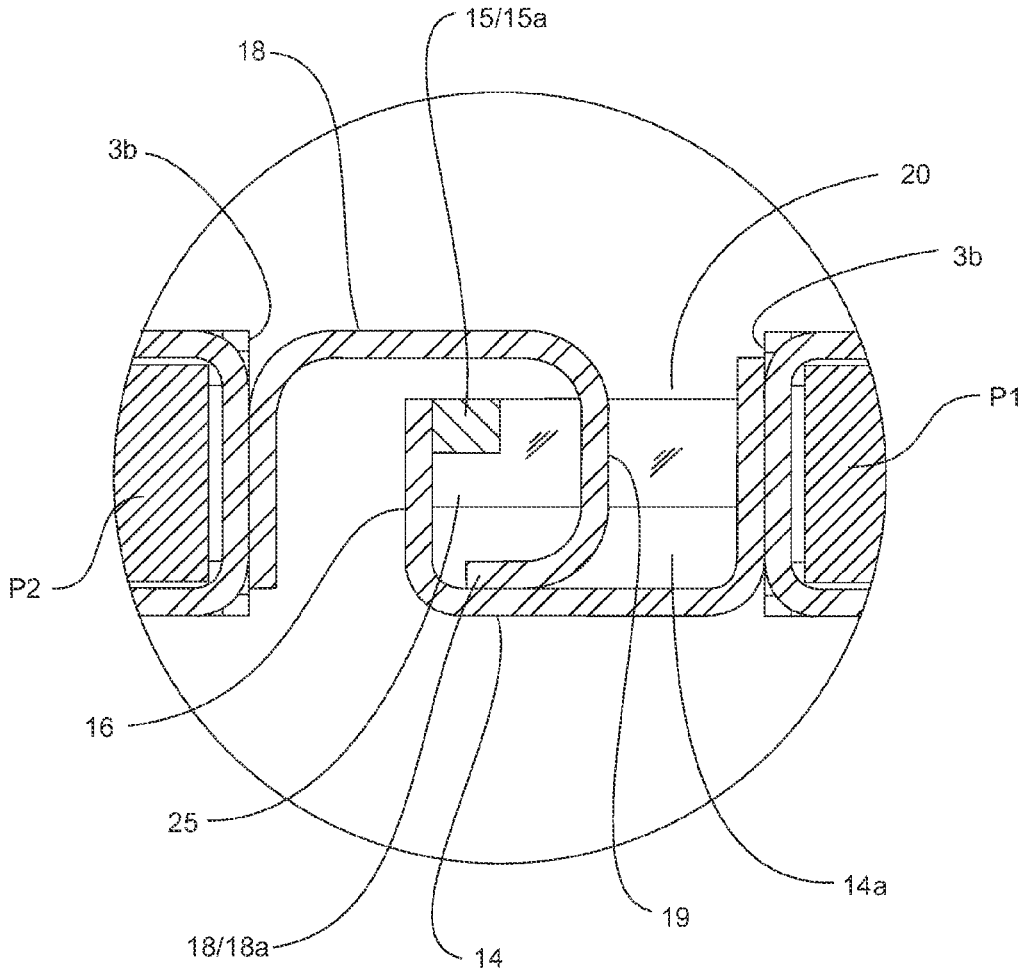
FIG. 9 is an enlarged view of the interconnection (circled portion IX in FIG. 8) between the two rig mat panels of FIG. 8 illustrating an assembly gap formed between the connecting edges of the two panels and details of the connectors.

As shown in FIG. 9, the first panel P1 is connected to the second panel P2 by inserting the depending member 19 of the second channel 17 in the recess 14*a* of the first channel 14, so that the depending member 19 is substantially parallel and spaced from the upstanding member 16.

In one embodiment and as shown in FIGS. 9 and 11, the first stop 15 comprises a first horizontal projection 15*a* extending from the upstanding member 16 of the first channel 14 towards the depending member 19 of the second channel 17 and the second stop 18 comprises a second horizontal projection 18*a* extending from the depending member 19 of the second channel 17 towards the upstanding member 16 of the first channel 14. Contacting of the second horizontal projection 18*a* against the upstanding member 16 prevents relative movement of the second panel P2 laterally away from the first panel P1.

Presence of the first stop 15*a* along the upstanding member 16 does interfere with direct lowering of the second channel 17 into the recess 14*a* of the first channel 14. For locating the depending member 19 in the recess of 14*a*, the second channel 17 must be first slid towards the first panel P1 so that travel of the depending member 19, lowering into the recess 14*a*, is not obstructed by the horizontal projection 15*a*. Once the first and second channels are engaged, an assembly gap 20 (best seen in FIG. 9) results between the connecting edge 3*b* of the first panel P1 and the depending member 19 of the second panel P2. The assembly gap 20 is a discontinuity in the working surface formed by the assembled rig mat 3. The assembly gap 20 can result in a safety hazard by making it possible for personnel working on the assembled rig mat to twist their ankles or trip.

Figure 10A:
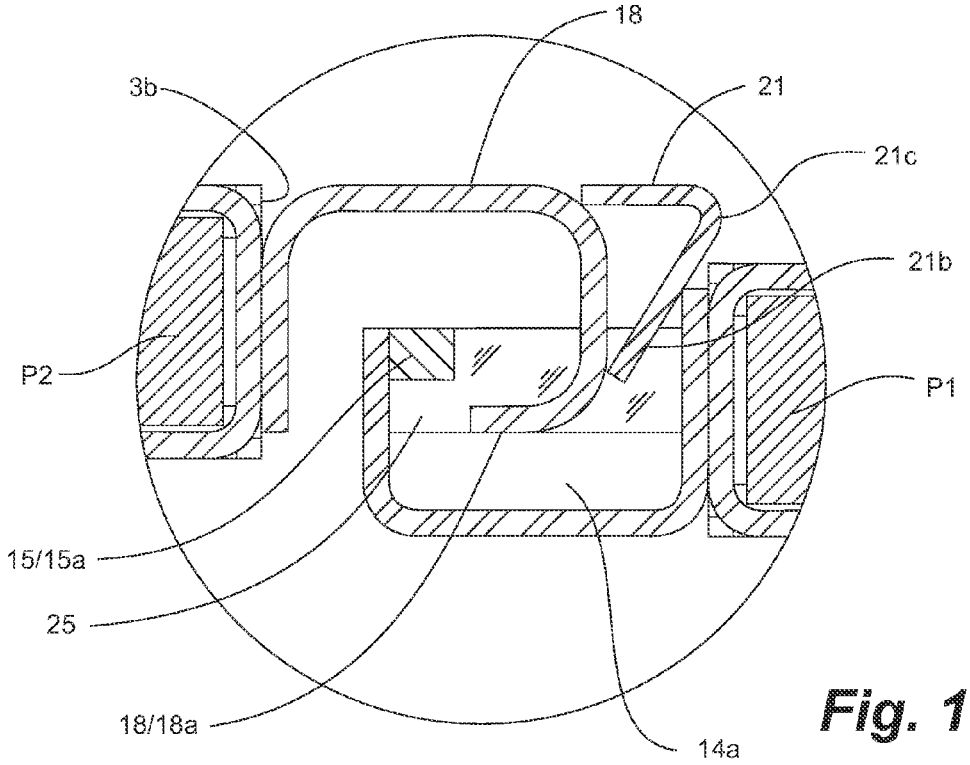
FIGS. 10A and 10B are side views of the interconnection between the two rig mat panels of FIG. 8 illustrating a filler for filling the assembly gap and various positions of the filler during interconnection.
Figure 10B:
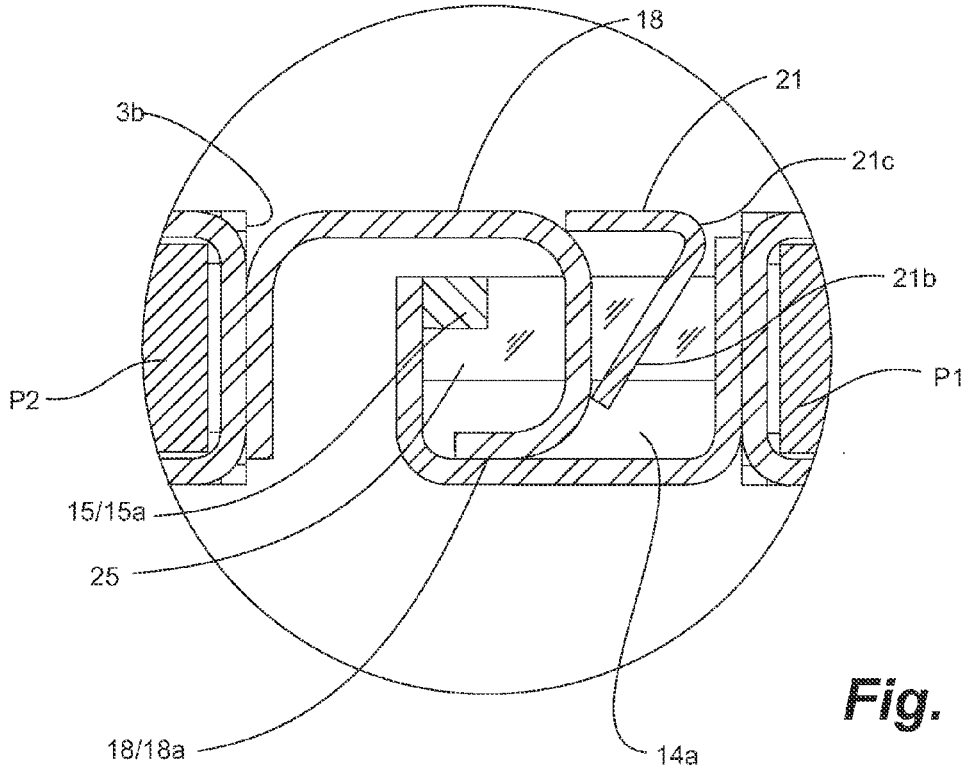

Accordingly, in another embodiment and as shown in FIGS. 10A and 10B, the connection means 40 includes means to minimize the gap 20. The assembly gap 20 is filled by a filler 21 which fits into the assembly gap 20. The filler 20 extends from the depending member 19 of the second channel 17 towards the connecting edge 3*b* of the first panel P1. Fitment of the filler 21 in the assembly gap 20 forms a substantially continuous surface in the rig mat between the connecting sides of the first panel P1 and second panel P2 (best seen in FIG. 12). The filler 21 also aids in preventing movement of the second panel P2 towards panel P1 and in making the first stop 15 and second stop 18 operational.

In one embodiment and as shown in FIGS. 10A and 10B, the filler 21 comprises a horizontal member 21*a* connected to a sloping guiding member 21*b*. The guiding member 21*b* slopes inwardly and downwardly towards the depending member 19 and enables location of the depending member 19 of the second channel 17 (best seen in FIG. 10A) in the recess 14*a*. Fitment of the filler 21 in the assembly gap 20 further laterally guides and aligns (best seen in FIG. 10B) the second horizontal projection 18*a* below the first horizontal projection 15*a*, forming a lift stop so as to prevent lifting of the depending member 19 from the recess 14*a* of the first channel 14.

Contacting of an end 21*c* (best seen in FIG. 10B) of the filler's horizontal member 21*a* against the connecting edge 3*b* of the first panel P1 prevents relative movement of the second panel P2 towards the first panel P1. As a result little or no movement of P2 towards P1 is possible. Further, any remaining gap, between the end 21*c* and the connecting edge 3*b* of the first panel P1 such gap can be filled with a sealant like poly-foam or caulking. The sealant prevents leakage to the barrier layer 5.

Figure 12:
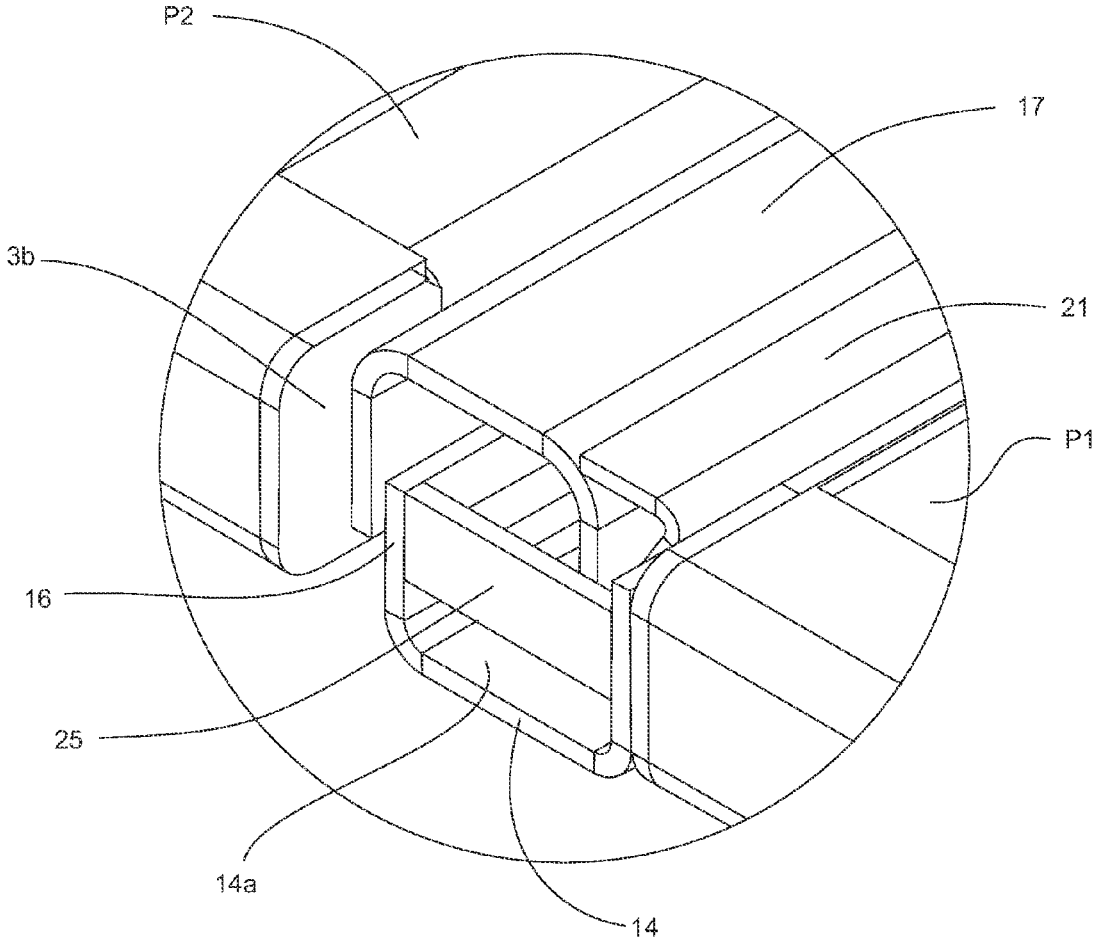
FIG. 12 is a side view of the interconnection between the two rig mat panels of FIG. 8 illustrating a side stop.

The channel 14 is further provided with at least one side-to-side stop along the length of the connection means 40. In one embodiment and as shown in FIG. 12, channel 14 is provided with a side stop 25 located at end thereof. The side stop 23 prevents longitudinal movement of the second channel 17. Contacting of an end 17*a* against side stop 25 prevents longitudinal movement of the second channel.

Figure 13:
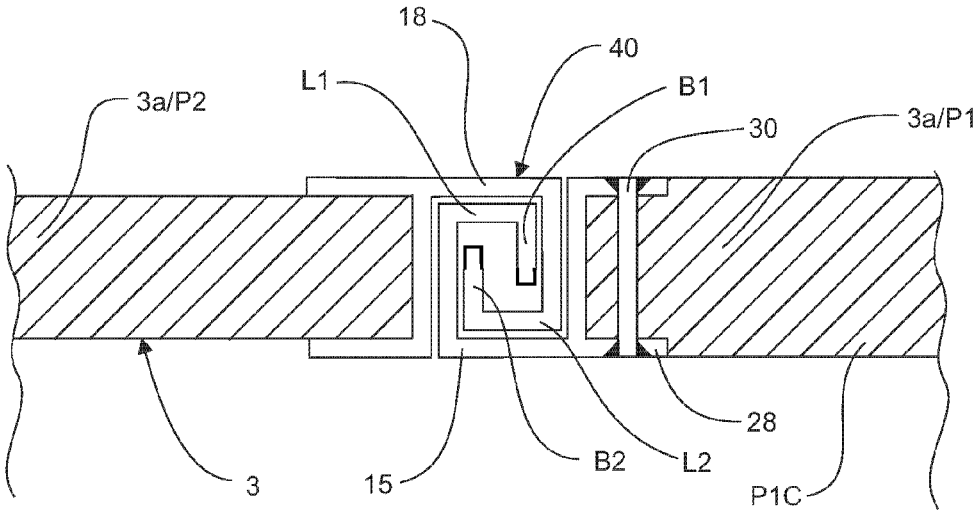
FIG. 13 is a side view illustrating another embodiment of the connectors.

In another embodiment and as shown in FIG. 13, the first stop 15 comprises a first L-shaped member L1 extending from the upstanding member 16 of the first channel 14 towards the depending member 19 of the second channel 17. The second stop 18 comprises a second L-shaped member L2 extending from the depending member 19 of the second channel 17 towards the upstanding member 16 of the first channel 14. The panels P1 and P2 are interconnected by inserting the second L-shaped member L2 from one end into the recess 14*a* such that a shorter base portion B2 of the second L-shaped member L2 is parallel to the upstanding member 16 of the first channel 14 and a shorter base portion B1 of the first L-shaped member L1 is parallel to the depending member 19. Contacting of the shorter base portion B1 of the first L-shaped member against the depending member 19 of the second channel 18 prevents relative movement of second panel P2 towards the first panel P1 and contacting of the shorter base portion B2 of the second L-shaped member against the upstanding member 16 of the first channel prevents relative movement of second panel P2 away the first channel P1. Further, the L-shaped members L1 and L2 prevent separation of panel P2 from panel P1 when load (not shown) is concentrated on panel P2 and panel P2 tends to tip. When subjected to this tipping movement panel P2 will rise, drawing with it the second L-shaped member L2. However, contacting of the second L-shaped member L2 against the first L-shaped member L1 prevents separation of the second L-shaped member L2 from the recess 14*a* thereby preventing separation of the two panels. The following examples describe various configurations of the rig mat system 1 for deployment over different terrains such as a frozen terrain and a swampy terrain.

In one embodiment, the rig mat panels 3*a* are rectangular and the connection means 40 are provided along the shorter edges 3*b* of the rig mat panels 3*b*. The longer edges 3*b* of the rig mat panels 3*a* can be provided with a guiding and retaining arrangement described in US Patent Application Publication No. US 2009/0297266.

In another embodiment, the rig mat panels 3*a* are rectangular and the connection means 40 are provided along the shorter edges and along the longer edges 3*b* of the rig mat panels 3*b*.

Figure 14:
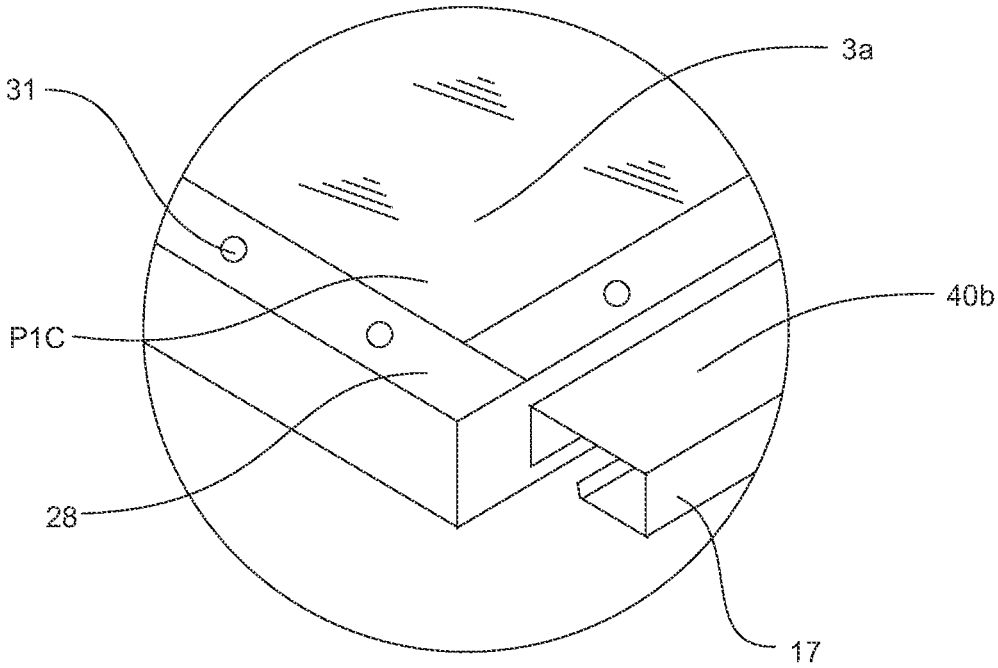
FIG. 14 is an enlarged view of the circled portion XIII of FIG. 8 illustrating an embodiment of a frame of the rig mat panel of FIG. 8.

In one embodiment and as shown in FIGS. 13 and 14, the frame 28 sits flush with the panel 3*b*. The core P1*c* of the panel P1 is indented at its edges for flush fitment with the frame 28. This prevents slips or trips. This also allows equipment to be slid over the assembled rig mat 3 with ease as well the assembled rig mat to be bladed.

In one embodiment and as shown in FIGS. 13 and 14, long section of the steel frame 28 is held in place by a series of pins 30 (best seen in FIG. 13). The pins 30 prevent the frame 28 from splaying outward and separating from the core P1*c*. The pins 30 can be inserted into vertical holes formed through the core P1*c* of the panel 3*a* and corresponding holes 31 (best seen in FIG. 14) in the steel frame 28. The pins 30 can be welded on the top and bottom side.

Figure 15:
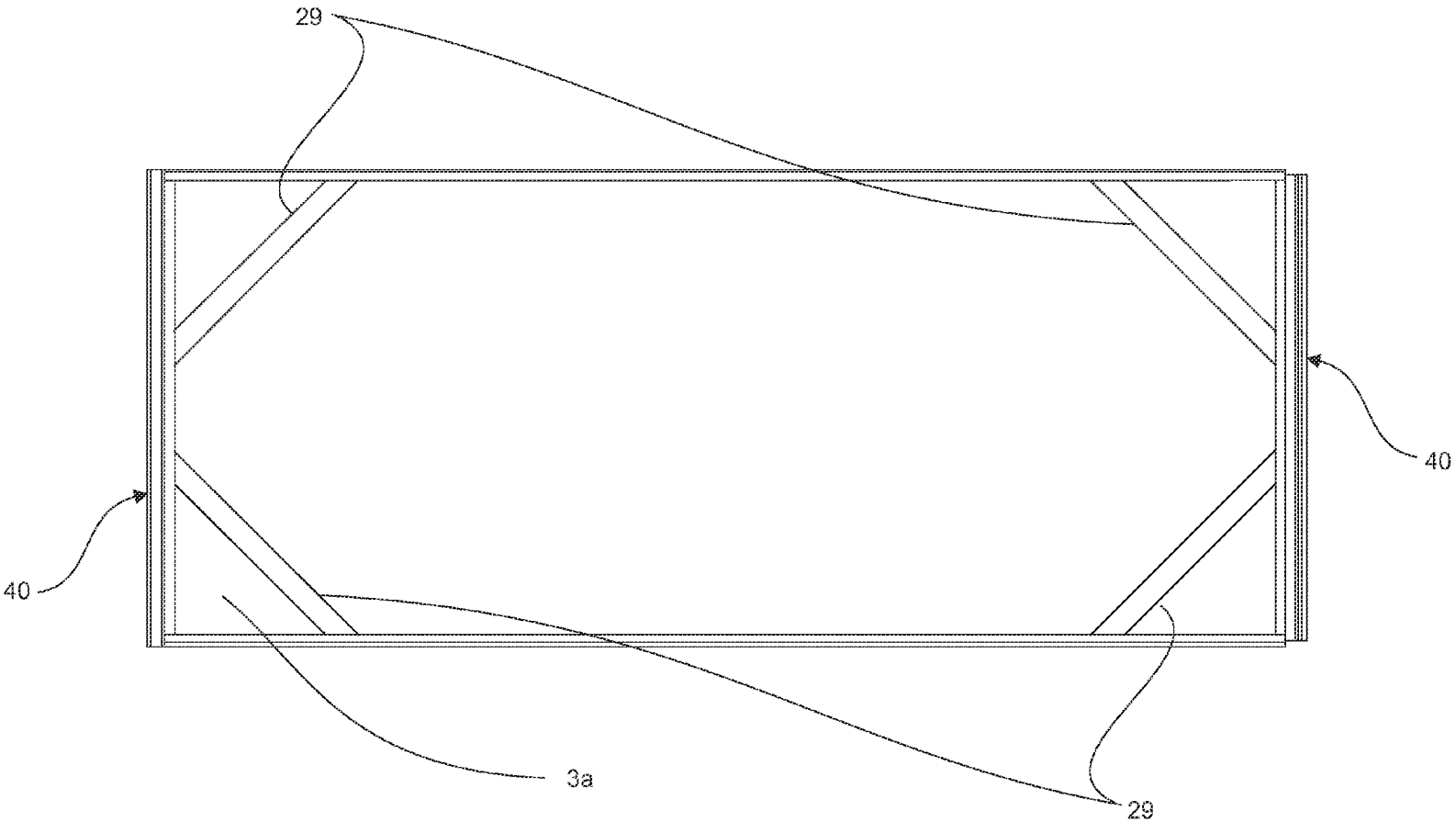
FIG. 15 is a bottom view of an embodiment of a panel of the rig mat system of FIG. 1.

In one embodiment and as shown in FIG. 15, reinforcements or braces 29 are added to the frame 28 to prevent the frame 28 from splaying.

In one embodiment, the rig mat system 1 is formed of composite material panels 3*a* and has the following technical advantages: ←75% weight than existing wood/steel panel rig mats, ←50% volume than existing rig mats, thermally insulating Arctic mat (rig mat) R5 or greater, thermally insulating geo membrane (barrier layer) R10 or greater, 100% spill containment, oil resistance, easy installation and repair capability in Arctic conditions, modular system to allow each layer to be used as required, greater compression strength than existing wooden panel rig mats (35,000 psf), interlocking for a stable working platform and Shear Modulus strength high enough to have same deflection performance as wood/steel rig mats.

The rig mat system 1 provides a lightweight, low profile, insulated, oil resistant matting solution for use in rig mats or temporary roadways in a variety of climates.

The rig mat system 1 will allow all the technical and environmental challenges to be met for Arctic deployment. Along with superior technical performance, the rig mat system 1 will allow engineers to use only the layers required for a particular job, hence saving money by using only engineered layers intended specifically to meet certain needs. For example, if the protective layer 6 is not important then there will be no expense associated with that feature in this layered approach. This solution will also be able to be used in other environments because of the flexible nature of the layered approach. Studies have led to the conclusion that a single material cannot meet the demands of the industry. The solution must partition the problem into distinct functions, each designed to handle a smaller task with emphasis in a smaller area. The individual parts can then be employed individually for specific purposes or in combination to handle the whole spectrum of requirements. The concept requires that the individual layers are able to work together with simplicity and no conflicting parameters.

Arctic Example

The rig mat system 1 for arctic deployment is formed by interconnecting rig mat panels 3*a* to form a rig mat 3 having a desired dimension. The panels 3*a* are formed of a composite material having an insulation value. The rig mat 3 is optionally provided with a top traction layer. The rig mat system 1 further comprises a barrier layer 5 formed by interconnecting barrier layer sections 5*a*. The rig mat 3 is placed on the barrier layer 5 such that discontinuities 3*c* in the rig mat are offset from sections edges 5*b*. Thus, the barrier layer 5 forms a substantially continuous liquid and thermal barrier below the discontinuities 3*c* in the rig mat 3. The barrier layer 5 prevents liquid or heat seeping through the rig mat 3 and discontinuities 3*c* from reaching the frozen terrain 2. All the discontinuities 3*c* in the rig mat 3 have a substantially uninterrupted barrier layer 5 therebelow. The barrier layer 5 is further placed on a protective layer 6 which extends across the entirety of the barrier layer 5. Any liquid seeping through the section edges 5*b* of the barrier layer 5 is prevented from reaching the frozen terrain 2 by the protective layer 6.

The rig mat system 1 for arctic deployment can be implemented in a method comprising: placing a protective layer 6 on a frozen terrain; placing a barrier layer 5 onto the protective layer 6; and forming a rig mat 3 of a desired dimension by interconnecting rig mat panels 3*a*; and placing the assembled rig mat 3 on the barrier layer 5 such that the barrier layer 5 forms a substantially continuous thermal and liquid barrier layer below discontinuities 3*c* in the rig mat 3.

The rig mat 3 provides a level working surface for equipment, machinery and motor vehicles. It also provides a thermal barrier to reduce the rate of energy travelling from the top side to the bottom side. The barrier layer 5 provides a second thermal barrier. The sizing of the panels 3*a* of the rig mat and the sections 5*a* of the barrier layer are different so that the discontinuities 3*c* in the rig mat are offset from the section edges 5*b* in the barrier layer 5. This ensures that there is no path directly to the frozen from the rig mat 3. This means that all the gaps in the rig mat 3 have an uninterrupted barrier layer 5 directly below them. The protective layer 6 prevents any spills of oils or fluids from the machinery and motor vehicles which move along or sit upon the barrier layer sections 5*a* from breaching the barrier layer 5 and reaching the frozen terrain. The layers are designed to provide a suitable coefficient of friction between them so that they do not move relative to each other during installation and use.

Swampy Terrain Example

A two-layer rig mat system 1 for deployment over a swampy terrain is formed by interconnecting rig mat panels 3*a* to form a rig mat 3 having a desired dimension. The rig mat 3 is optionally provided with a top traction layer. The rig mat 3 is placed on a barrier layer 5 such that the barrier layer forms a continuous liquid barrier at the discontinuities 3*c* in the rig mat. The barrier layer 6 prevents liquid seeping through the rig mat discontinuities 3*c* from reaching the swampy terrain. The barrier layer 5 is placed on a protective layer 6 which extends across the entirety of the barrier layer 5. The protective layer 6 prevents any liquid seeping through the barrier layer from reaching the underlying swampy terrain.

The rig mat need not provide thermal or reflective insulation value. It just needs to provide a rigid surface for loads placed thereon.

The two layer rig mat system 1 for deployment over a swampy terrain can be implemented in a method comprising: placing a barrier layer 5 over a swampy terrain; forming a rig mat 3 of a desired dimension by interconnecting rig mat panels 3*a*; and placing the assembled rig mat 3 on the barrier layer 5 such that the barrier layer 5 forms a substantially continuous liquid barrier layer below discontinuities 3*c* in the rig mat 3.

The invention claimed is:

1. A rig mat system comprising:

a plurality of rig mat panels interconnected by connecting edges in an edge-to-edge arrangement by connectors located at the connecting edge of each panel, the connectors comprising:

a first U-shaped channel along the connecting edge of a first panel of the plurality of panels, the first channel defining a recess and having an upstanding member of the first channel spaced from the connecting edge of the first panel, and a first stop extending from the upstanding member towards the first panel;

a second inverse U-shaped channel along the connecting edge of a second panel of the plurality of panels, the second channel having a depending member of the second channel spaced from the connecting edge of the second panel, and a second stop extending from the depending member towards the second panel, wherein upon a lowering insertion of the depending member and second stop of the second channel into the recess of the first channel, the depending member of the second channel and the upstanding member of the first channel interconnect the first panel to the second panel, and the first and second stops are alignable for preventing lifting of the depending member of the second channel from the recess of the first channel.

2. The system of claim 1 having discontinuities along the connecting edges of the panels forming a leak path to a terrain below the rig mat further comprising, a barrier layer between the panels and the terrain wherein a surface area of the barrier layer is at least equal to a surface area of the panels so as to form a substantially continuous liquid barrier between the discontinuities and the terrain.

3. The system of claim 2 wherein the barrier layer further forms a thermal barrier below the discontinuities in the rig mat.

4. The system of claim 3 wherein the barrier layer comprises a geo-membrane associated with a liquid impermeable sheet to form both the liquid barrier and the thermal barrier below the discontinuities in the rig mat.

5. The system of claim 4 wherein the geo-membrane is encased in the liquid impermeable sheet.

6. The system of claim 4 wherein the liquid impermeable sheet is a reinforced polyethylene sheet.

7. The system of claim 4 wherein the core of the geo-membrane comprises a rigid plastic reinforcement mesh encapsulated in layers of woven strong fabric.

8. The system of claim 4 wherein the core of the geo-membrane comprises a high-stranded, high-density, polyethylene matrix configured to create interstitial space.

9. The system of claim 1 wherein the barrier layer comprises a plurality of sections arranged along section edges to form the barrier layer, an aggregate surface area of the plurality of sections being at least equal to the surface area of the rig mat.

10. The system of claim 9 wherein a surface area of each panel of the rig mat is different from a surface area of each section of the barrier layer.

11. The system of claim 9 wherein the section edges are offset from the discontinuities in the rig mat.

12. The system of claim 9 further comprising a protective layer contacting the terrain and underlying the entirety of the rig mat and the barrier layer to prevent at least liquid, seeping through the plurality of sections of the barrier layer, from reaching the terrain.

13. The system of claim 9 wherein the plurality of sections of the barrier layer are interconnected along their section edges.

14. The system of claim 13 wherein the section edges are plastic and the sections edges are interconnected by heat sealing.

15. The system of claim 13 wherein the section edges are interconnected by interconnecting means such as a hook-and-loop fastener, double-sided tape or zipper.

16. The system of claim 13 wherein the section edges are plastic and interconnected by wedge welding.

17. The system of claim 9 wherein the barrier layer is formed by placing the sections of the barrier layer edge-to-edge below the rig mat.

18. The system of claim 1 wherein the rig mat has a surface layer forming a top traction layer.

19. The system of claim 1 wherein an assembly gap is formed between the connecting edge of the first panel and the depending member of the second panel, further comprising a filler for fitment into the assembly gap, the filler extending from the depending member towards the connecting edge of the first panel, wherein fitment of the filler in the assembly gap forms a substantially continuous surface in the rig mat between the connecting edges of the first panel and second panel and prevents relative movement of the second panel towards the first panel.

20. The system of 19 wherein the fitment of the filler into the assembly gap aligns the second stop below the first stop so as to align the first and second stops to prevent the lifting of the depending member of the second channel from the recess of the first channel, and contacting of the second stop against the upstanding member of the first channel prevents relative movement of the second panel away from the first panel.

21. The system of claim 19 wherein the filler comprises a horizontal member and a sloping guiding member, the horizontal member extending from the depending member towards the connecting edge of the first panel and the sloping guiding member slopes inwardly towards the depending member, the sloping guiding member engages the connecting edge of the first panel during lowering insertion for guiding insertion of the depending member into the recess of the first channel.

22. The system of 1 wherein, the first stop further comprises a first L-shaped member extending from the upstanding member of the first channel towards the depending member of the second channel, a shorter base portion of the first L-shaped member is parallel to the depending member, and the second stop further comprises a second L-shaped member extending from the depending member of the second channel towards the upstanding member of the first channel, shorter base portion of the second L-shaped member is parallel to the upstanding member of the first channel, wherein contacting of the shorter base portion of the first L-shaped member against the depending member of the second channel prevents relative movement of second channel towards the first channel and contacting of the shorter base portion of the second L-shaped member against the upstanding member of the first channel prevents relative movement of second channel away from the first channel.

23. The system of claim 1 wherein the first channel comprises at least one side stop along a length thereof.

24. The system of claim 23 wherein the at least one side stop is located at an end of the first channel.

25. The system of claim 1 wherein the panels of the rig mat are made of wood.

26. The system of claim 1 wherein the panels of the rig mat are composite material panels which are thermally insulating.

27. The system of claim 26 wherein the composite panel incorporates a foam and Z-axis weaving.

28. The system of claim 26 wherein the composite panel incorporates wetted fiber insertions and an internal baffle.

29. Connecting edges for interconnection of a panels of a rig mat system comprising:

a first U-shaped channel along a first connecting edge of the panel, the first channel defining a recess and having an upstanding member of the first channel spaced from the first connecting edge of the panel, and a first stop extending from the upstanding member towards the panel; and a second inverse U-shaped channel along a second opposing connecting edge of the panel, the second channel having a depending member of the second channel spaced from the connecting edge of the panel, and a second stop extending from the depending member towards the panel, wherein the second inverse U-shaped channel from the panel accepts a first U-shaped channel from a second panel for interconnecting a plurality of like panels for forming the rig mat, and the first and second stops being alignable for preventing lifting of the depending member of the second channel from the recess of the first channel.

30. The system of claim 29 wherein an assembly gap is formed between the connecting edge of the first panel and the depending member of the second panel, further comprising a filler for fitment into the assembly gap, the filler extending from the depending member towards the connecting edge of the first panel, wherein fitment of the filler in the assembly gap forms a substantially continuous surface in the rig mat between the connecting edges of the first panel and second panel and prevents relative movement of the second panel towards the first panel.

31. The system of 30 wherein the fitment of the filler into the assembly gap aligns the second stop below the first stop so as to prevent the lifting of the depending member of the second channel from the recess of the first channel, and contacting of the second stop against the upstanding member of the first channel prevents relative movement of the second panel away from the first panel.

32. The system of claim 30 wherein the filler comprises a horizontal member and a sloping guiding member, the horizontal member extending from the depending member towards the connecting edge of the first panel and the sloping guiding member slopes inwardly towards the depending member, the sloping guiding member engages the connecting edge of the first panel during lowing insertion for guiding insertion of the depending member into the recess of the first channel.

33. The system of 29 wherein, the first stop further comprises a first L-shaped member extending from the upstanding member of the first channel towards the depending member of the second channel, a shorter base portion of the first L-shaped member is parallel to the depending member, and the second stop further comprises a second L-shaped member extending from the depending member of the second channel towards the upstanding member of the first channel, shorter base portion of the second L-shaped member is parallel to the upstanding member of the first channel, wherein contacting of the shorter base portion of the first L-shaped member against the depending member of the second channel prevents relative movement of second channel towards the first channel and contacting of the shorter base portion of the second L-shaped member against the upstanding member of the first channel prevents relative movement of second channel away from the first channel.

34. The connecting edges of claim 29 wherein the first channel comprises at least one side stop along a length thereof.

35. The system of claim 34 wherein the at least one side stop is located at an end of the first channel.

* * * * *